US009145698B2

(12) United States Patent
Korbel

(10) Patent No.: US 9,145,698 B2
(45) Date of Patent: Sep. 29, 2015

(54) SHEET MEMBER CORNER RETAINING SYSTEM

(75) Inventor: Bradley D. Korbel, Califon, NJ (US)

(73) Assignee: International Swimming Pools, Inc., New Brunswick, NJ (US)

( * ) Notice: Subject to any disclaimer, the term of this patent is extended or adjusted under 35 U.S.C. 154(b) by 767 days.

(21) Appl. No.: 13/177,895

(22) Filed: Jul. 7, 2011

(65) Prior Publication Data

US 2013/0007956 A1 Jan. 10, 2013

(51) Int. Cl.
*E04H 4/00* (2006.01)
*E04H 4/14* (2006.01)

(52) U.S. Cl.
CPC ..... *E04H 4/14* (2013.01); *E04H 4/144* (2013.01); *E04H 2004/146* (2013.01)

(58) Field of Classification Search
CPC ..... E04H 4/0056; E04H 4/0018; E04H 4/00; E04H 4/0031; E04H 4/0043; E04H 4/141; E04H 4/142; E04H 15/642; E04H 15/644
USPC ..... 4/506, 600; 52/169.7, 102, 63, 22; 160/327
See application file for complete search history.

(56) References Cited

U.S. PATENT DOCUMENTS

| | | | | | |
|---|---|---|---|---|---|
| 911,767 | A | | 2/1909 | Seelye | |
| 3,177,501 | A | | 4/1965 | Kwake | |
| 3,478,370 | A | | 11/1969 | Stern et al. | |
| 3,755,981 | A | | 9/1973 | West | |
| 3,783,931 | A | * | 1/1974 | Assael | 160/327 |
| 3,811,236 | A | * | 5/1974 | Fiddes | 52/102 |
| 3,949,960 | A | * | 4/1976 | McKee | 248/220.21 |
| 4,083,157 | A | * | 4/1978 | Anthonioz | 52/222 |
| 4,158,244 | A | | 6/1979 | Stefan | |
| 5,025,604 | A | * | 6/1991 | Yeamans | 52/273 |
| 5,029,422 | A | | 7/1991 | Scherrer | |
| 5,970,669 | A | * | 10/1999 | Livingston | 52/222 |
| 6,260,313 | B1 | | 7/2001 | Stegmeier | |
| 6,457,189 | B1 | | 10/2002 | Kindness | |
| 6,662,383 | B2 | | 12/2003 | Cornelius et al. | |
| 6,671,895 | B2 | | 1/2004 | Lewis | |
| 7,040,060 | B2 | | 5/2006 | Cox | |
| 7,861,471 | B2 | * | 1/2011 | Smith | 4/506 |
| 8,661,749 | B2 | * | 3/2014 | Gibson | 52/182 |
| 8,857,115 | B2 | * | 10/2014 | Epple | 4/496 |
| 2006/0008235 | A1 | * | 1/2006 | Krampotich et al. | 385/136 |
| 2008/0235862 | A1 | | 10/2008 | Lewis et al. | |

FOREIGN PATENT DOCUMENTS

| | | |
|---|---|---|
| GB | 1179232 | 1/1970 |

* cited by examiner

*Primary Examiner* — Lauren Crane
*Assistant Examiner* — Erin Deery
(74) *Attorney, Agent, or Firm* — Walter W. Duft

(57) ABSTRACT

A rigid frame structure has a corner retaining configuration for retaining a sheet member to an inside corner of the frame structure. First and second panel members are arranged to form the frame structure's inside corner. A gap of nominal gap width is disposed at the inside corner between a rear edge of the second panel member and a face of the first panel member. One or more retaining members partially close the gap to provide corresponding areas of reduced gap width. Each retaining member is formed on or attached to a surface of the first or second panel member that defines a first or second side of the gap without mechanical fastening to both sides of said gap. The nominal gap width is sized to receive one or more bead elements on the sheet member, and the reduced gap width traps the one or more bead elements within the gap, thereby retaining the sheet member to the inside corner.

18 Claims, 6 Drawing Sheets

SHEET MEMBER CORNER RETAINING SYSTEM

BACKGROUND

1. Field

The present disclosure relates to in-ground (and above-ground) vinyl swimming pool installations and other constructions wherein a flexible sheet member needs to be attached to a rigid support structure. More particularly, the disclosure concerns a technique for retaining a flexible sheet member to a support structure inside corner configuration.

2. Description of the Prior Art

By way of background, vinyl swimming pools are conventionally constructed with a flexible water-tight liner made from heavy duty vinyl. For an above-ground vinyl swimming pool construction, the bottom of the liner is supported by a suitable base made from packed sand or the like. The sides of the liner are supported by a rigid sidewall made from components such as metal, plastic or wood panels. For an in-ground vinyl swimming pool construction, the liner is supported within an excavation whose shape provides a desired perimeter configuration and depth contour of the swimming pool. The bottom of the excavation typically comprises a vermiculite cement or packed sand base. The sides of the excavation are typically lined with a rigid side wall. The side wall can be constructed from panels made of steel, plastic, fiberglass or wood. Alternatively, the side wall can be constructed as a formed concrete wall or from concrete blocks.

For both above-ground and in-ground vinyl swimming pools, the upper peripheral edge of the liner usually comprises a bead that is secured in a track at the top of the side wall. Such pools generally also have a stair system and possibly a "swim-out" bench system, each of which may be fabricated using various materials. For in-ground vinyl swimming pools, commonly-used stair and bench system materials include steel, molded plastic and poured concrete. For above-ground vinyl swimming pools (which may have an inside stair system, an outside stair system, or both), molded plastic is usually the material of choice, but other materials may also be used.

For both stair and bench systems, there will be least one inside corner where the bottom edge of a vertical component (e.g., a stair riser) intersects the rear edge of a horizontal component (e.g., a stair tread or pool bottom). The liner typically needs to be attached to the inside corner(s) in order to prevent unsightly (and potentially unsafe) wrinkling and bulging. This is particularly the case near the top of a stair system where there may only be a few inches of water to hold the liner in place. In addition to holding the liner in place, the liner attachment needs to be releasable to allow for the liner to be replaced in the future.

As shown in FIG. 1, the preferred technique used for many years to retain a vinyl swimming pool liner at the inside corner of a stair or bench system has been to form loops "L" on the back of the liner that slide over a fiberglass retaining rod "R." The retaining rod "R" is secured to the underlying stair or bench structure using metal spring clips "C." The spring clips "C" are deformable so that they can be inserted between a gap "G" that is provided at the inside corner tread/riser intersection. In some cases, clip insertion can be expedited by loosening one or more bolts that hold together the stair or bench structure (if constructed as an assembly). This allows the gap "G" to be temporarily enlarged in order to make it easier to insert the spring clips "C." Following insertion, the spring clips "C" return to their original configuration, thereby holding the liner firmly against the inside corner.

One drawback of the rod/clip technique is that the outline of the retaining rod "R" is visible through the liner following installation. Some individuals find this visually unattractive. The rod/clip technique is also difficult or impossible to use when installing replacement liners because it requires the spring clips "C" to be inserted between the step riser and step tread after they have been cemented into place and have no flexibility to move and allow the spring clips to slide between them. This often necessitates the application of adhesives to retain the replacement liner. Such adhesives may cause accelerated deterioration of the liner. The use of adhesives also makes future liner replacements difficult.

More recently, a bead and track system has been used for corner retention areas. As shown in FIG. 2, this prior art system incorporates a liner lock extrusion "E" that is mounted between the riser and tread components when the stair or bench system is assembled. The extrusion "E" has an upper channel that is substantially U-shaped. A small retaining flange "F" is formed at the upper edge of one of the channel sidewalls to partially close off the channel opening. A liner bead "B" is attached in a suitable manner (e.g., using R.F. welding) to the back side of the liner. To secure the liner to the inside corner, the liner bead "B" is inserted into the channel, where it is trapped in place by the retaining flange "F". This method works satisfactorily from a mechanical standpoint, but has several problems. First, the cost of the stair or bench system is high because of the assembly process required. Second, the extrusion must be separately fabricated or purchased from a third party, thus further increasing costs. Third, the extrusion gets sandwiched between two components of the stair or bench system. In some cases, the extrusion will be made from aluminum and the stair or bench system components will be sheets of zinc-coated steel. This may lead to corrosive galvanic action. In other cases, the extrusion will be made from plastic. Such extrusions are subject to wear and may become brittle over time.

SUMMARY

An improved rigid frame structure has a corner retaining configuration for retaining a sheet member at an inside corner of the frame structure. A first frame structure panel member is oriented in a first direction. The first panel member may serve as a riser if the frame structure comprises a stair system, or a seat back if the frame structure comprises a bench system. A second frame structure panel member is oriented in a second direction that is oblique to the first direction. The second panel member may serve as a tread if the frame structure comprises a stair system, or a seat if the frame structure comprises a bench system. If the frame structure is for a swimming pool, the sheet member may comprise a water-retaining vinyl liner. The first panel member and the second panel member are arranged to form the frame structure's inside corner. A gap having a nominal gap width is disposed at the inside corner between a rear edge of the second panel member and a face of the first panel member. One or more retaining members partially close the gap to provide corresponding areas of reduced gap width. Each retaining member is formed on or attached to a surface of either the first or second panel member that defines a first side or a second side of the gap without the need for mechanical fastening to both sides of the gap. The nominal gap width is sized to receive one or more bead elements disposed on one side of the sheet member. The reduced gap width is sized to trap the one or more bead elements within the gap. The sheet member may thus be disposed to cover the first panel member and the second panel member, and so that the one or more bead elements are trapped in the gap by the one or more retaining members in order to retain the sheet member to the inside corner.

In an embodiment, the rigid frame structure may comprise an assembly wherein the first panel member and the second panel member comprise separate components that are mounted to each other by one or more fasteners. An integral system could also be used. The first panel member and the second panel member may be joined by a spacer member that is sized to define the nominal gap width. The spacer member may be formed as an integral part of the second panel member. The one or more retaining members may be integrally formed as part of the rear edge of the second panel member or as part of the front face of the first panel member (or at other locations). The one or more bead elements may include reduced thickness connecting portions (e.g., flaps) that are sized to pass through the areas of reduced gap width. The oblique angle between the first panel member and the second panel member may be selected according to design requirements, but will typically be substantially ninety degrees.

In a further aspect, the rigid frame structure may be combined with the sheet member to provide a corner retaining system installation in which the sheet member is retained at the inside corner of the frame structure.

In another aspect, a tread/riser unit is provided that may be assembled into a rigid stair or bench assembly with one or more inside corners having a corner retaining configuration for retaining a sheet member on the stair or bench assembly.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 3:
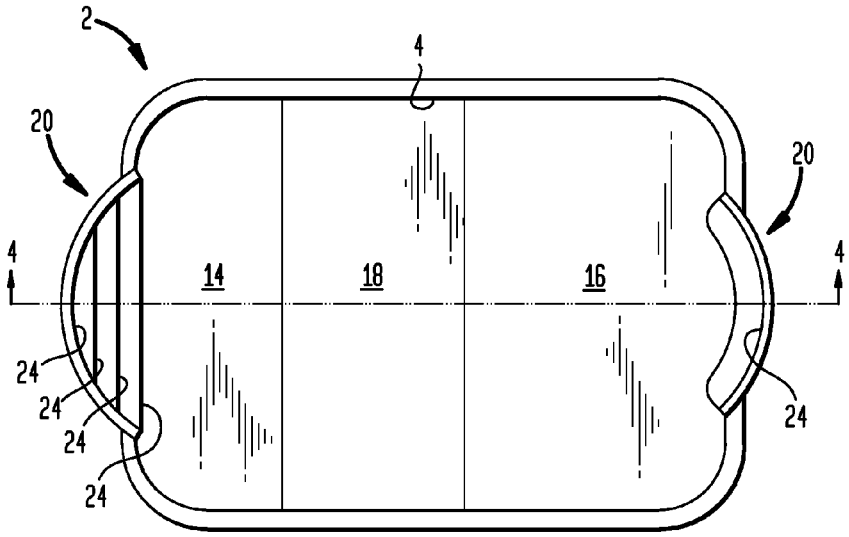
FIG. 3 is a plan view showing an in-ground vinyl swimming pool having a stair system at one end and a swim-out bench system at the other end.
Figure 4:
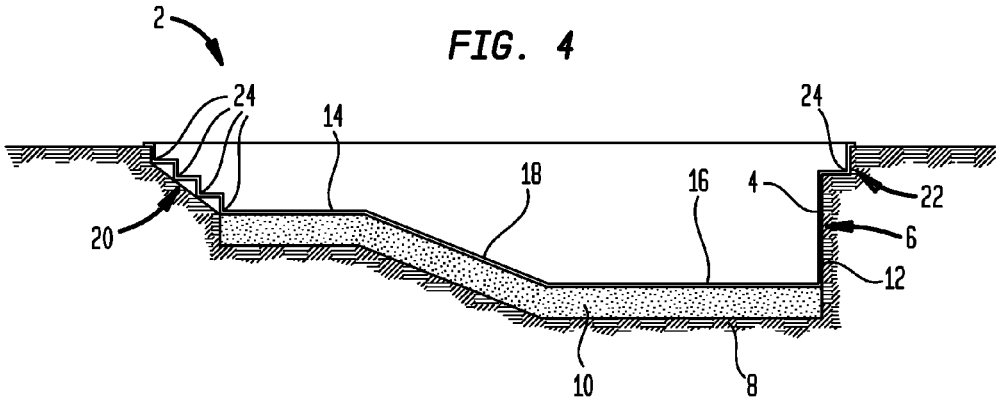
FIG. 4 is a cross-sectional view taken along line 4-4 in FIG. 3.

Turning now to FIGS. 3 and 4, a vinyl in-ground swimming pool 2 is shown for the purpose of illustrating a representative example environment in which the corner retaining technique disclosed herein may be applied. It should be understood that disclosed corner retaining technique could also be used with other types of vinyl swimming pools, including above-ground pools, as well as for non-swimming pool applications. The swimming pool 2 has a flexible water-tight liner 4 that can be made from heavy duty vinyl or other suitable material. As can be seen in FIG. 4, the liner 4 is supported within a below-grade excavation 6 formed in the ground 8. The bottom of the excavation 6 comprises a base 10 comprising vermiculate concrete, packed sand or other suitable material that is capable of supporting the bottom of the liner 4 and the weight of the water above. The sides of the excavation are lined with a rigid side wall 12. The side wall 12 may be constructed in various ways. For example, panels made of steel, plastic, fiberglass or wood may be used. Alternatively, the side wall 12 may be constructed as a formed concrete wall or from concrete blocks. Although not shown, the upper peripheral edge of the liner 4 comprises a bead that is secured in a track at the top of the side wall, as is known in the art.

The liner 4 is shaped to correspond to the swimming pool's perimeter configuration and depth contour. In the embodiment of FIGS. 3-4, the swimming pool's perimeter configuration is generally rectangular and its depth contour is such as to provide a shallow end 14, a deep end 16, and a sloping transition region 18. The liner 4 is also shaped to accommodate a stair system 20 installed at the shallow end 14 and a swim-out bench system 22 installed at the deep end 16. Each of these systems has at least one inside corner 24 where the liner needs to be attached in order to prevent unsightly (and potentially unsafe) bulging. In particular, the stair system 20 shown in FIGS. 3-4 has several inside corners 24 produced by tread/riser intersections and by the intersection of a lowermost riser with the bottom of the pool's shallow end 14. The bench system 22 of FIGS. 3-4 has a single inside corner 24 produced by the intersection of the seat and seat-back portions of the bench.

The stair system 20 and the bench system 22 may be constructed as rigid frame structures made from zinc-coated steel or other suitable material (including molded plastic or poured concrete). In the illustrated embodiment of FIGS. 3-4, the frame structure for the stair system 20 has a set of three horizontal panel members that provide the stair treads and a set of four vertical panel members that provide the stair risers. It will be appreciated that the stair system frame structure may have additional or fewer tread/riser pairs in other stair systems that are either longer or shorter than the stair system 20 shown in FIGS. 3-4. The frame structure for the bench system 22 has a single horizontal panel member that provides the bench seat and a single vertical panel member that provides the seat back. As described in more detail below, the frame structures for the stair system 20 and the bench system 22 are designed with a novel corner retaining configuration that retains the liner 4 to the inside corners 24 in a manner that overcomes the disadvantages associated with the existing prior art techniques discussed in the "Background" section above.

Figure 5:
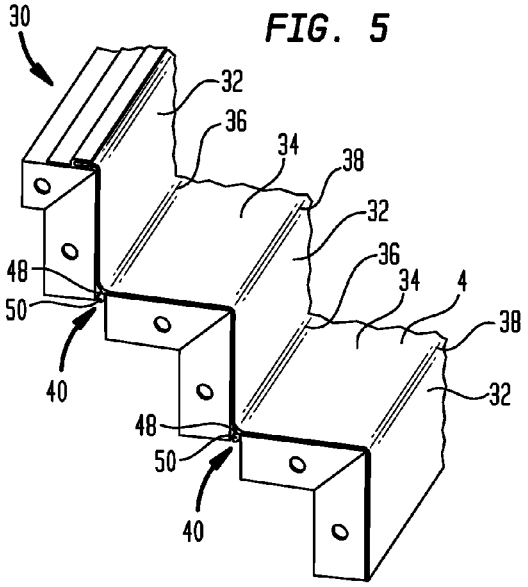
FIG. 5 is a perspective view showing a corner retaining system installation in which a vinyl liner is retained at the inside corner(s) of a generic frame structure that may be customized to provide the stair system or the bench system in the swimming pool of FIG. 3.
Figure 6:
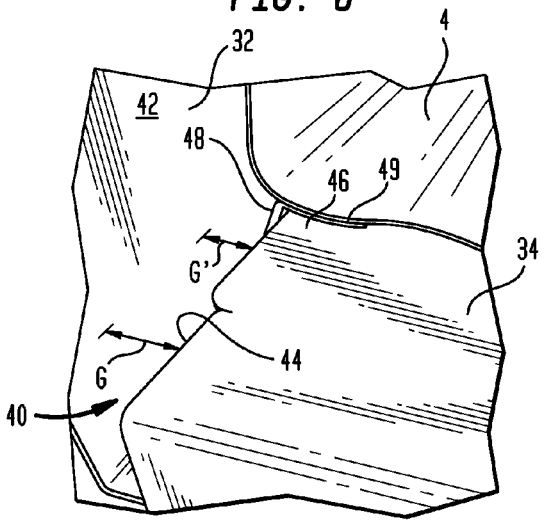
FIG. 6 is an enlarged fragmentary perspective view showing the corner retaining system installation of FIG. 5.
Figure 7:
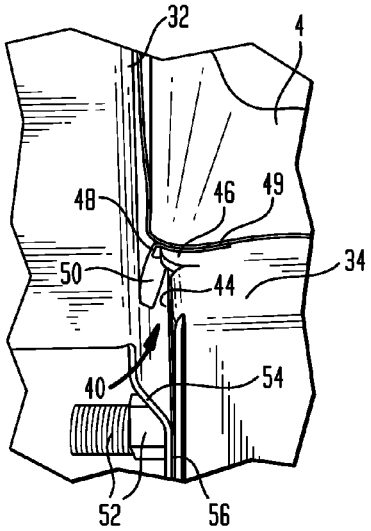
FIG. 7 is a further enlarged fragmentary perspective view showing the corner retaining system installation of FIG. 5.
Figure 8:
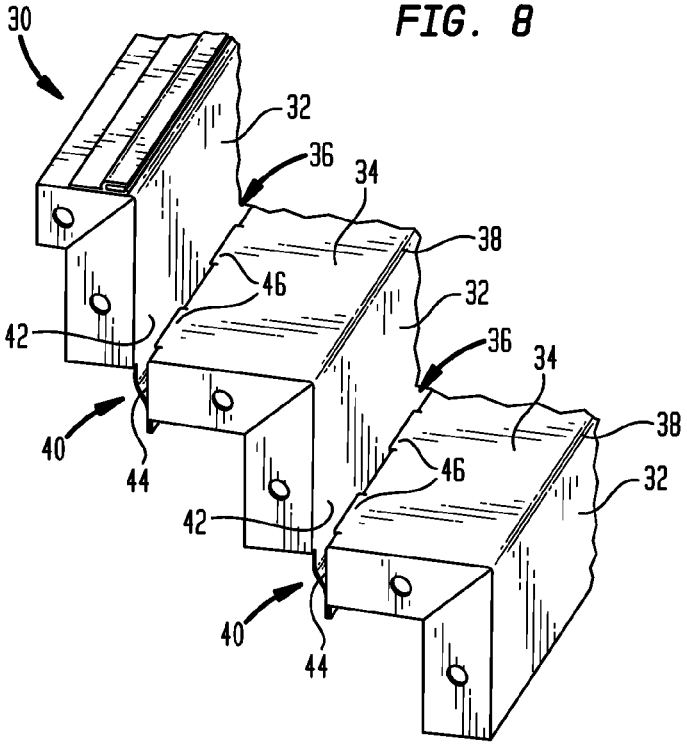
FIG. 8 is a perspective view showing the generic frame structure of the corner retaining system installation of FIG. 5.
Figure 9:
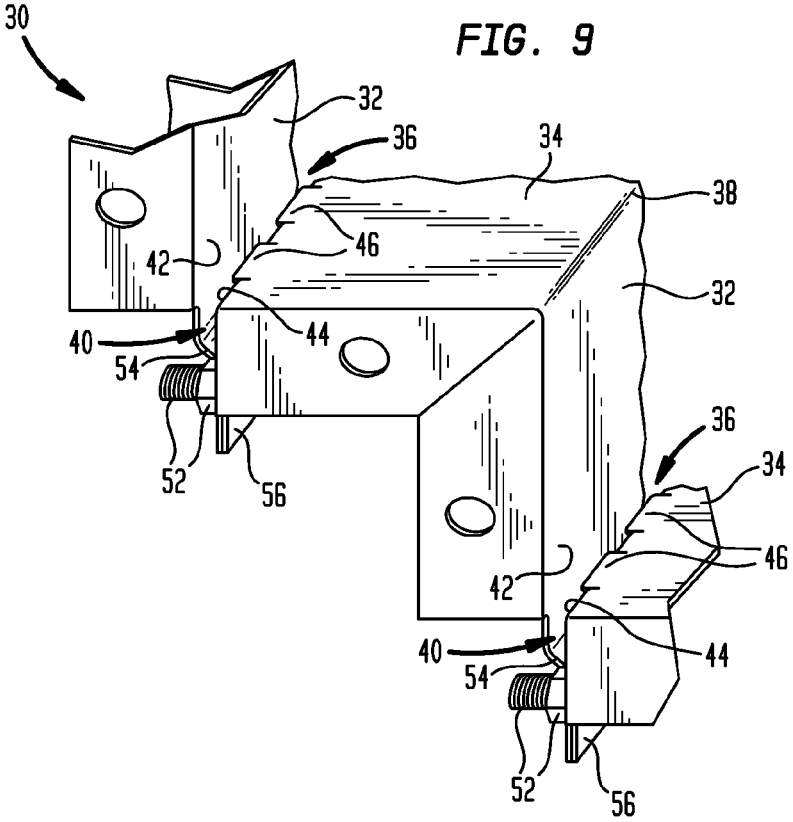
FIG. 9 is an enlarged fragmentary perspective view showing the generic frame structure of FIG. 8.

Turning now to FIGS. 5-9, reference number 30 represents a generic rigid frame structure design that may be used to construct the stair system 20 and the bench system 22 with the desired inside corner retention capability. The generic frame structure 30 has a set of vertical frame structure panel members 32 and a set of horizontal frame structure panel member 34. Although the generic frame structure 30 is depicted as having three vertical panel members 32 and two horizontal panel members 34, this is for purposes of illustration only. The actual number of vertical and horizontal panel members 32/34 will be selected to match the intended end use. Thus, for the stair system 20 of FIGS. 3-4, the generic frame structure 30 would be customized to have four vertical panel members 32 that provide the stair system's four risers and three horizontal panel members 34 that provide the stair system's three treads. Similarly, for the bench system 20 of FIGS. 3-4, the generic frame structure 30 would be customized to have a single vertical panel member 32 that provides the seat-back portion of the bench system and a single horizontal panel member 34 that provides the seat portion of the bench system. The vertical panels 32 and the horizontal panels 34 are arranged to form inside corners 36 of the generic frame structure 30. Outside corners 38 are also formed by the vertical and horizontal panels 32/34. As described in more detail below, the generic frame structure 30 is configured so that the liner 4 will be retained at each of the inside corners 36 without wrinkling or bulging. FIGS. 5-7 illustrate the frame structure 30 with the liner 4 installed thereon. This installation (comprising the generic frame structure 30 and the attached liner 4) may be referred to as a corner retaining system installation. FIGS. 8 and 9 illustrate the generic frame structure 30 without the liner 4.

It should be understood that the generic frame structure 30 is not necessarily limited to vinyl swimming pool applications. Rather, the generic frame structure 30 may be used for any application in which a sheet member (regardless of type) requires inside corner retention. A carpeted stairway would be one example. Broadly speaking, the generic frame structure 30 may thought of as having one or more first panel members oriented in a first direction and one or more second panel members oriented in a second direction. Although the panel members in FIGS. 5-9 are either vertical (i.e., the panel members 32) or horizontal (i.e., the panel members 34), so as to be mutually orthogonal, the panel members in other embodiments could be oriented at oblique angles that are not necessarily ninety degrees, or even substantially ninety degrees.

As can be seen in each of FIGS. 5-9, a gap 40 is disposed at the inside corners 36 of the generic frame structure 30. Each gap 40 extends between a face 42 of one of the vertical panel members 32 and a rear edge 44 of an adjacent one of the horizontal panel members 34. The distance between the vertical panel member face 42 and the horizontal panel member rear edge 44 defines a nominal gap width G (see FIG. 6). For each gap 40, a set of spaced liner retaining members 46 may be formed on or attached to a common support surface of either the vertical panel member 32 or the horizontal panel member 34 that defines a first side or a second side of the gap 40. The liner retaining members 46 associated with any given gap 40 may be mutually aligned in the direction of the gap along the length of the corresponding inside corner 36. The liner retaining members 46 may be separated from each other by a suitable spacing distance that will depend on the number of liner retaining members being used (e.g., two, three, four, etc.), their size, and the intended application. For best results, the spacing between each liner retaining member 46 may be equal to or less than the length of the liner retaining member. However, larger spacing distances may also be used. For some applications, a single elongated liner retaining member 46 may be used in lieu of a set of spaced liner retaining members. Thus, the generic frame structure 30 may have one or more liner retaining members 46, depending on design requirements.

Each liner retaining member 46 associated with a particular gap 40 is positioned to extend from its support surface one either side of the gap so as to partially close the gap 40 and provide a corresponding area of reduced gap width G' (see FIG. 6). In the example embodiment of FIGS. 5-9, the liner retaining members 46 are integrally formed in the shape of flat rectangular retainer tabs as part of the rear edges 44 of the horizontal panel members 34. One example technique that may be used to integrally form such retainer tabs is described in more detail below in connection with FIG. 10. Another example technique in which the liner retaining members 46 may be integrally formed on the vertical panel member face 42 (or at other support surface locations on the vertical or horizontal panel members) is described in more detail below in connection with FIGS. 11-12.

Figure 2:
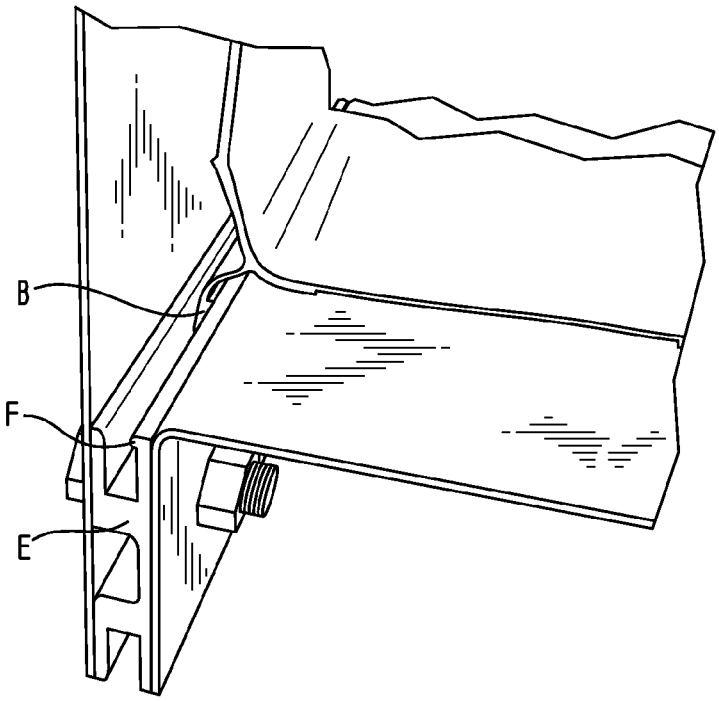
FIG. 2 (PRIOR ART)
FIG. 2 is a fragmentary perspective view showing a second prior art corner retaining system for a swimming pool liner.

Although an integral forming technique may simplify manufacturing and lower production costs, it should be understood that the liner retaining members 46 could be formed on the desired support surface (on either side of the gap 40) in other ways, such as by welding or adhesive bonding. The liner retaining members 46 could also be attached to the desired support surface, as by mechanically fastening them using fasteners (e.g., screws, bolts, rivets, etc.), clips or other attachment components. Although not shown in the drawing figures, the liner retaining members 46 may include additional structure (such as flanges) to facilitate their formation on, or attachment to, a desired support surface location. Thus, the flat rectangular retainer tab configuration shown in FIGS. 5-9 (and in FIGS. 10-12) is for purposes of illustration only. For an attachment-type fabrication technique, the use of liner retaining members 46 made from the same material as the generic frame structure 30, or from an inert material, should prevent galvanic corrosion at the point of contact between such components. Advantageously, no portion of any liner retaining member 46 (whether provided as a flat retainer tab or in any other configuration) needs to be separately mechanically fastened to both sides of a given gap 40 (like the extrusion "E" of FIG. 2). Nor does any liner retaining member 46 need to be retained in a gap 40 in other labor-intensive ways (such as by wedging the liner retaining member into the gap as a separate insert after the gap is formed).

As can be seen in FIGS. 5-7, the back side of the liner 4 has one or more flexible bead elements 48 on its underside (one for each inside corner 36 of the generic frame structure 30). The bead elements 48 are arranged so that they will be positioned at the inside corners 36 when the liner 4 is installed. The bead elements 48 may run continuously along the length of each gap 40, or they may be segmented and non-continuous. As best shown in FIG. 6, a first end portion 49 of each bead element 48 is anchored to the the back of the liner 4 using a suitable attachment technique, such as radio frequency (R.F.) welding. The anchored end portion 49 of each bead element 48 runs parallel to the back of the liner 4 for a short distance and is in contacting relationship with the liner at the area of attachment. The bead elements 48 then bend downwardly and away from the liner 4 to extend into one of the gaps 44. The terminal end of each bead element 48 is enlarged to provide a bulbous bead element tip 50 (best shown in FIG. 7). The anchored end portion 49 of each bead element 48 represents an attached base end of the bead element and the bead element tip 50 represents an enlarged terminal end of the bead element. The remaining intermediate portion of each bead element 48 serves as a reduced thickness connecting portion that carries the bead element tip 50. It should be noted that the foregoing bead element construction is conventional in the vinyl swimming pool industry, as are other types of bead element construction. The nominal gap width G of each gap 40 is sized to receive and accommodate one of the bead element tips 50. However, the reduced gap width G' defined by the liner retaining members 46 is sized to trap the bead element tip 50 within the gap 40. Only the thinner connecting portion of the bead elements 48 will fit easily within the reduced gap width G'.

When the liner 4 is installed on the generic frame structure 30, each bead element tip 50 may be inserted into its corresponding gap 40 using a suitable technique so that the bead element tip will be trapped within the gap by the liner retaining members 46. For example, if the bead element tips 50 are made of a compressible material (such as vinyl) they be squeezed in order to reduce their thickness and then pressed past the liner retaining members 46 into the corresponding gap 40. Once the bead element tips 50 have been inserted in this manner, they will expand back to their original thickness that is too wide to pass through the reduced gap width G'. To facilitate the foregoing insertion technique, the size of the liner retaining members 46 may be selected to define a precise size of the reduced gap width G'. In particular, the liner retaining members 46 may have a gap-closing dimension that allows the reduced gap width G' to receive the bead element tips 50 in their compressed state while trapping the bead element tips in their uncompressed state with sufficient retaining force to prevent liner pull-out during normal use (but allowing liner removal for replacement purposes). The gap-closing dimension of each liner retaining member 46 begins at the support surface from which it extends and terminates at the free end thereof that protrudes into the gap 40. In this way, the liner 4 can be easily installed and fully retained at the inside corners 36 of the generic frame structure 30 in a safe and efficient manner.

The generic frame structure 30 may be fabricated using any suitable manufacturing technique, including as an integral (e.g., molded) item or as an assembly of parts. According to the assembly technique, the vertical panel members 32 and the horizontal panel members may comprise separate components that are mounted to each other by one or more fasteners, such as the bolt/nut fasteners 52 shown in FIGS. 7 and 9. As further shown in FIGS. 7 and 9, the vertical panel members 32 may include a downwardly and forwardly extending spacer member 54 that is sized to define the gap 40 (with its nominal gap width G). The spacer member 54 may be connected by the bolt/nut fasteners 52 to a rear flange 56 that extends vertically downwardly from the rear edge 44 of a forwardly adjacent horizontal panel member 34. It will also be seen in the illustrated embodiment that the gap 40 may have substantially parallel planar sidewalls due to one sidewall thereof being defined by a vertical panel member face 42 of one of the vertical panel members 32 and the other sidewall being defined by a vertical rear flange 56 of one of the horizontal panel members 34.

Figure 10:
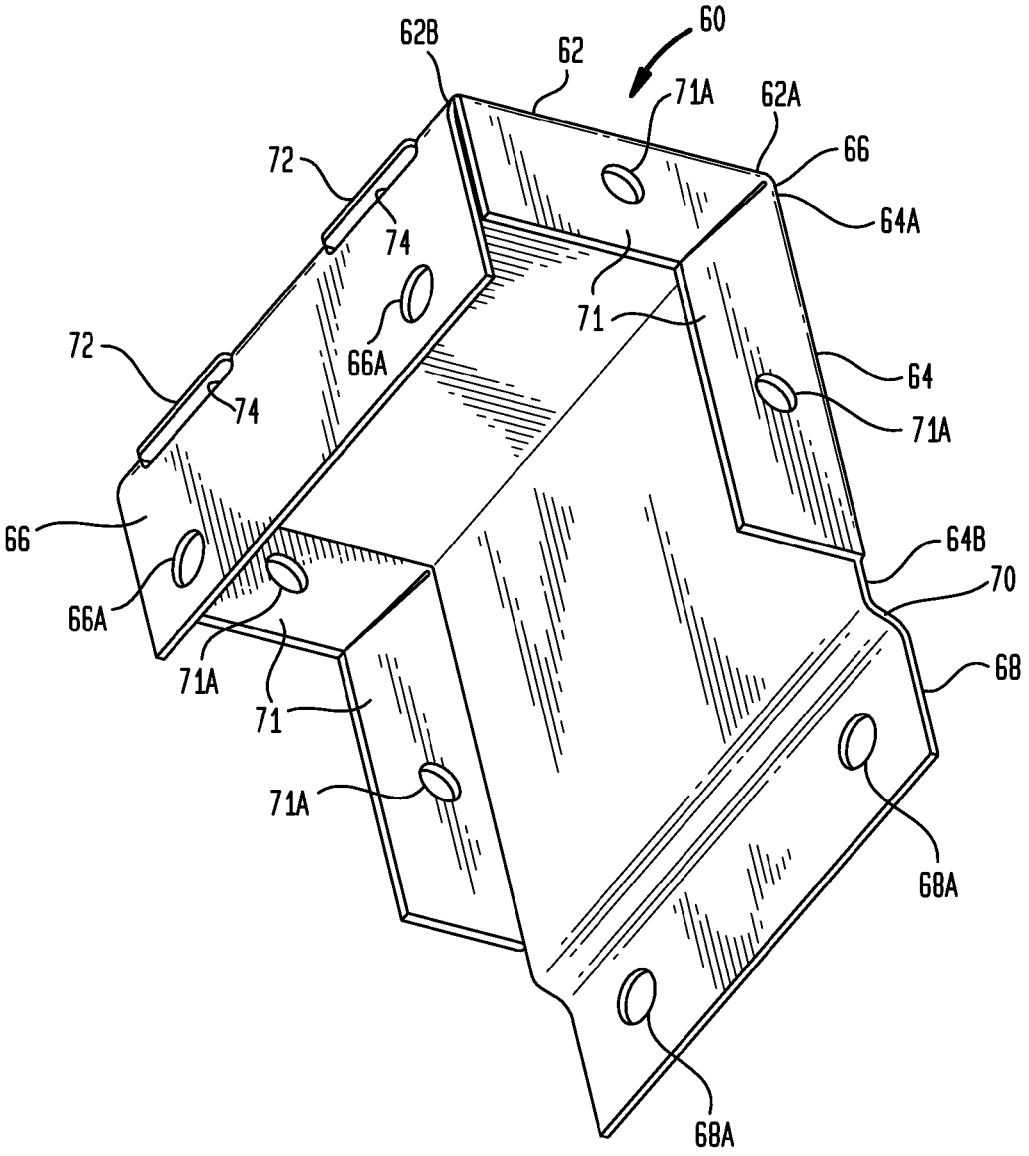
FIG. 10 is a perspective view showing a tread/riser unit that may be used as a component of the generic frame structure of FIG. 8.

In an example embodiment, the generic frame structure 30 may be fabricated from a set of frame structure tread/riser units, one of which is shown by reference number 60 in FIG. 10. The tread/riser unit 60 may be constructed from flat sheet metal stock (e.g., zinc-galvanized steel) that is formed in a desired shape and configuration that includes a tread 62 oriented in a first direction and a riser 64 oriented in a second direction that is substantially perpendicular to the first direction. A front edge 62A of the tread 62 meets a top edge 64A of the riser 64 to define an outside corner 66 of the tread/riser unit 60. The outside corner 66 corresponds to one of the generic frame structure outside corners 38. A rear edge 62B of the tread 62 corresponds to one of the rear edges 44 of the generic frame structure 30. The rear edge 62B is bent to form a downwardly depending rear mounting flange 66 that corresponds to one of the rear flanges 56 of the generic frame structure 30. A front face 64B of the riser 64 extends downwardly to form a downwardly depending front mounting flange 68 having an offset 70 that corresponds to one of the spacer members 54 of the generic frame structure 30.

The rear mounting flange 66 and the front mounting flange 68 have respective mounting holes 66A and 68A for receiving fasteners, such as the bolt/nut fasteners 52 of FIGS. 7 and 9. The rear mounting flange 66 of the tread/riser unit 60 is configured to connect to the front mounting flange 68 of a rearwardly adjacent tread/riser unit of like construction that would be located above and behind the illustrated tread/riser unit in the generic frame structure 30. Similarly, the front mounting flange 68 of the tread/riser unit 60 is configured to connect to the rear mounting flange 66 of a forwardly adjacent tread/riser unit of like construction that would be located below and in front of the illustrated tread/riser unit in the generic frame structure 30. As additionally shown in FIG. 10, the tread/riser unit 60 may be formed with side flanges 71 for assembly purposes and to increase rigidity and load-bearing capacity. One set of side flanges 71 is formed on the side edges of the tread 62 and the other set of side flanges is formed on the side edges of the riser 64. The side flanges 71 may be formed with mounting holes 71A for making attachments to adjacent support structure (not shown), or to other tread/riser units of like construction (depending on the width of the stair or bench system to be formed and the length of each individual tread/riser unit).

As mentioned, the rear mounting flange 66 is used for connecting the illustrated tread/riser unit 60 to the front mounting flange 68 a rearwardly adjacent tread/riser unit of like construction. This connection will define one of the inside corners 36 of the generic frame structure 30 in which there is a gap 40 having a nominal gap width G. The gap 40 will lie between the rear edge 62B of the illustrated tread/riser unit 60 and the riser front face 64B of the rearwardly adjacent tread/riser unit. One or more rearwardly extending retainer tabs 72 may be integrally formed on the rear edge 62B to provide the liner retaining members 46 of the generic frame structure 30 that partially close the gap 40 to provide corresponding areas of reduced gap width G'. Each retainer tab 72 may be formed by making a U-shaped cut 74 in the sheet stock used to form the tread/riser unit 60. The U-shaped cuts 74 define the shape of each retainer tab 72. They are made along a line where the sheet stock will be bent to form the rear edge 64B of the tread 64 and the beginning of the downwardly depending rear mounting flange 66. The retainer tabs 72 are not bent downwardly and instead remain in the plane of the tread 62, such that they extend rearwardly from the rear edge 62B as flat rectangular tab members. It will be appreciated that other fabrication techniques could also be used to form (or attach) the retainer tabs 72 on the tread/riser unit 60.

As also mentioned, the front mounting flange 68 is used for connecting the illustrated tread/riser unit 60 to the rear mounting flange 66 of a forwardly adjacent tread/riser unit of like construction. This connection will also define one of the inside corners 36 of the generic frame structure 30 in which there is a gap 40 having a nominal gap width G. The gap 40 will lie between the riser front face 64B of the illustrated tread riser unit 60 and the rear edge 62B of the rearwardly adjacent tread/riser unit. The gap width G will be defined by the size of the offset 70 of the front mounting flange 68, which gives the front mounting flange a forwardly extending dimension to form the gap 40.

The tread/riser unit 60 may be used by itself or in combination with any number of other tread/riser units of like construction when fabricating the generic frame structure 30.

In this way, the generic frame structure 30 can be customized to form any type of stair or bench system, including but not limited to the stair system 20 or the bench system 22 of the in-ground vinyl swimming pool 2 shown in FIGS. 3-4. Alternatively, one or more of the tread/riser units 60 could be used to fabricate the generic frame structure 30 so as to have other configurations or to be used in other applications.

Figure 11:
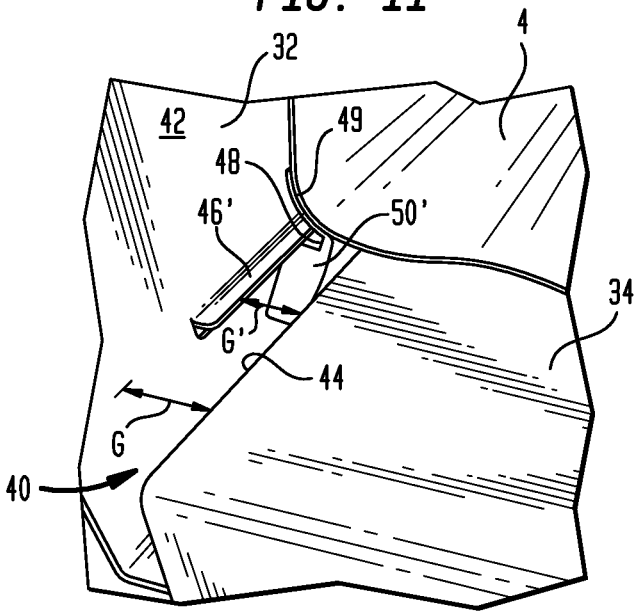
FIG. 11 is an enlarged fragmentary perspective view showing the corner retaining system installation of FIG. 5 in accordance with an alternate embodiment.
Figure 12:
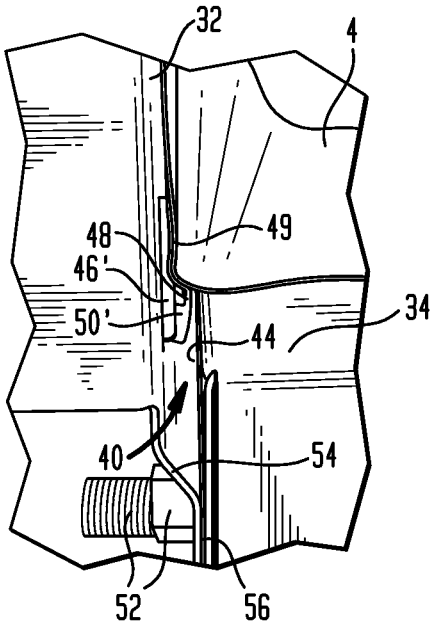
FIG. 12 is a further enlarged fragmentary perspective view showing the corner retaining system installation of FIG. 5 in accordance with an alternate embodiment.

Accordingly, a technique for retaining a sheet member to an inside corner of a rigid structure has been disclosed. Although various embodiments have been shown and described, it should be apparent that many variations and alternative embodiments could be implemented in accordance with the present disclosure. For example, as shown in FIGS. 11 and 12, instead of (or in addition to) providing one or more liner retaining members 46 on the rear edge 44 of the treads 34 (i.e., at the front side of the gap 44), one or more liner retaining members 46' could be formed on or attached to the vertical face 42 of the risers 32 (i.e., at the rear side of the gap 44). For example, the liner retaining members 46' could be integrally formed as flat rectangular retainer tabs that are bent outwardly from the vertical face 42 after making suitable cuts in the riser 32 (e.g., U-shaped cuts) to define each retainer tab. Other forming or attachment techniques (such as welding, adhesive bonding, mechanical fastening) and mounting locations (e.g., on the spacer member 54 of the vertical panel member 32 or the rear flange 56 of the horizontal panel member 34) may also be used. Note that if the liner retaining members 46' are provided on the vertical face 42, it may be desirable to attach the bead element 48 to the liner 4 in a reverse direction so that the bead element tip 50 faces rearwardly to better engage the liner retaining members (which are located at the rear of the gap 44). This alternative bead element arrangement is shown in FIGS. 11 and 12. It will be appreciated that the tread/riser unit 60 of FIG. 10 may be suitably modified if it is desired to replace the retainer tabs 72 on the rear edge 62B of the tread 62 with retainer tabs on the vertical face 64B of the riser 64.

Figure 1:
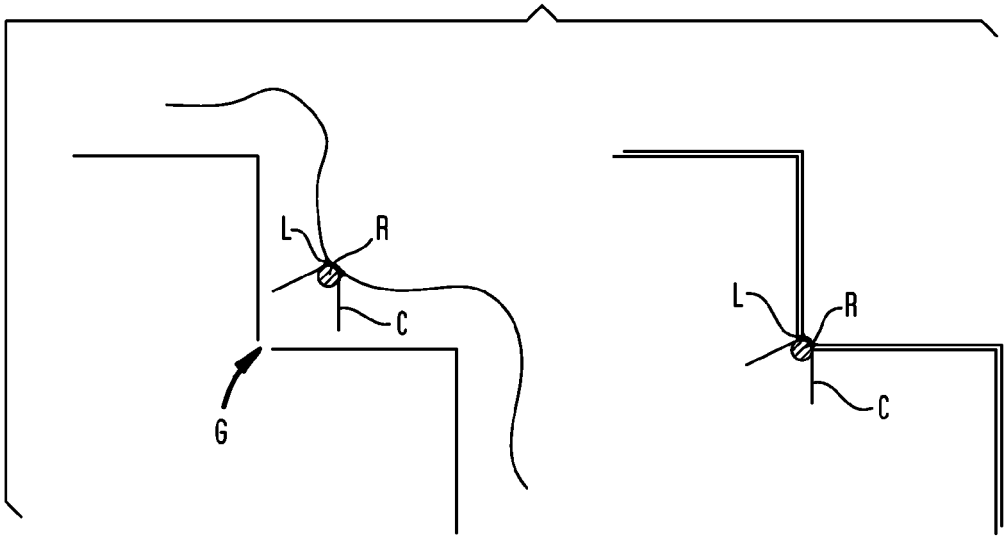
FIG. 1 (PRIOR ART)
FIG. 1 is a side view showing a first prior art corner retaining system for a swimming pool liner.

As a further modification, it would also be possible to secure the liner 4 to the liner retaining members 46 (or 46') using a retaining rod instead of the bead elements 48. In that case, the retaining rod could be passed through loops on the back side of the liner 4 in the manner shown in FIG. 1. The retaining rod may be formed from a material that is somewhat compressible so that it can be pressed into the gap 40 until it locks below the liner retaining members 46 (or 46'). Advantageously, the retaining rod would not be visible under the liner as it is in the prior art installation of FIG. 1. Instead, the retaining rod would be seated inside the gap 40, where it is not visible.

It is understood, therefore, that the invention is not to be in any way limited except in accordance with the spirit of the appended claims and their equivalents.

What is claimed is:

1. A rigid frame structure having a corner retaining configuration for retaining a sheet member at an inside corner of the frame structure, comprising:

a first frame structure panel member oriented in a first direction;

a second frame structure panel member oriented in a second direction that is oblique to said first direction;

said first panel member and said second panel member being arranged to form said inside corner;

a gap disposed between a rear edge of said second panel member and a face of said first panel member, said gap having a nominal gap width;

one or more retaining members partially closing said gap to provide one or more corresponding areas of reduced gap width, each of said retaining members being formed on a surface of said first panel member or said second panel member that defines a first side or a second side of said gap without mechanically fastening said retaining members to both sides of said gap;

said one or more retaining members each being defined by a cut in said surface that forms a retainer tab, and either said retainer tab or said surface being bent so that said retainer tab extends from said surface;

said nominal gap width being sized to receive one or more bead elements disposed on one side of said sheet member, and said reduced gap width being sized to trap said one or more bead elements within said gap;

whereby, said rigid frame structure is configured so that said sheet member is capable of covering said first panel member and said second panel member, and so that said one or more bead elements are trapped in said gap by said one or more retaining members in order to retain said sheet member to said inside corner.

2. The frame structure of claim 1, wherein said rigid frame structure comprises a stair system or a bench system for a vinyl swimming pool, wherein there are one or more of said first panel member forming one or more risers and one or more of said second panel member forming one or more treads, and wherein said rigid frame structure is adapted for use with said sheet member comprised as a water-retaining vinyl liner for said swimming pool.

3. The frame structure of claim 1, wherein said rigid frame structure comprises an assembly wherein said first panel member and said second panel member comprise separate components that are mounted to each other by one or more fasteners.

4. The frame structure of claim 1, wherein said first panel member and said second panel member are joined by a spacer member that is sized to define said nominal gap width.

5. The frame structure of claim 1, wherein said one or more bead elements comprise one or more reduced thickness connecting elements, said one or more connecting elements being sized to pass through said areas of reduced gap width.

6. The frame structure of claim 1, wherein said first direction and said second direction define an oblique angle between said first panel member and said second panel member that is substantially ninety degrees.

7. A corner retaining system installation in which a sheet member is retained at an inside corner of a rigid frame structure, comprising:

a first frame structure panel member oriented in a first direction;

a second frame structure panel member oriented in a second direction that is oblique to said first direction;

said first panel member and said second panel member being arranged to form said inside corner;

a gap disposed between a rear edge of said second panel member and a face of said first panel member, said gap having a nominal gap width;

one or more retaining members partially closing said gap to provide one or more corresponding areas of reduced gap width, each of said retaining members being formed on a surface of said first panel member or said second panel member that defines a first side or a second side of said gap without mechanically fastening said retaining members to both sides of said gap;

said one or more retaining members each being defined by a cut in said surface that forms a retainer tab, and either said retainer tab or said surface being bent so that said retainer tab extends from said surface;

said nominal gap width being sized to receive one or more bead elements disposed on one side of said sheet member, and said reduced gap width being sized to trap said one or more bead elements within said gap; and said sheet member being disposed to cover said first panel member and said second panel member, and said one or more bead elements being trapped in said gap by said one or more retaining members in order to retain said sheet member to said inside corner.

8. The installation of claim 7, wherein said rigid frame structure comprises a stair system or a bench system for a vinyl swimming pool, wherein there are one or more of said first panel member forming one or more risers and one or more of said second panel member forming one or more treads, and wherein said rigid frame structure is adapted for use with said sheet member comprised as a water-retaining vinyl liner for said swimming pool.

9. The installation of claim 7, wherein said rigid frame structure comprises an assembly wherein said first panel member and said second panel member comprise separate components that are mounted to each other by one or more fasteners.

10. The installation of claim 7, wherein said first panel member and said second panel member are joined by a spacer member that is sized to define said nominal gap width.

11. The installation of claim 7, wherein said one or more bead elements comprise one or more reduced thickness connecting elements, said one or more connecting elements being sized to pass through said areas of reduced gap width.

12. The installation of claim 7, wherein said first direction and said second direction define an oblique angle between said first panel member and said second panel member that is substantially ninety degrees.

13. A rigid frame structure having a corner retaining configuration for retaining a sheet member at an inside corner of the frame structure, comprising:

a first frame structure panel member oriented in a first direction;

a second frame structure panel member oriented in a second direction that is oblique to said first direction;

said first panel member and said second panel member being arranged to form said inside corner;

a gap disposed between a rear edge of said second panel member and a face of said first panel member, said gap having a nominal gap width;

one or more retaining members integrally formed as part of said second panel member or said first panel member, said one or more retaining members being arranged to partially close said gap to provide one or more corresponding areas of reduced gap width;

said one or more retaining members each being defined by a cut in a surface of said second panel member or said first panel member that forms a retainer tab, and either said retainer tab or said surface being bent so that said retainer tab extends from said surface;

said nominal gap width being sized to receive one or more bead elements disposed on one side of said sheet member, and said reduced gap width being sized to trap said one or more bead elements within said gap;

whereby, said rigid frame structure is configured so that said sheet member is capable of covering said first panel member and said second panel member, and so that said one or more bead elements are trapped in said gap by said one or more retaining members in order to retain said sheet member to said inside corner.

14. A rigid frame structure having a corner retaining configuration for retaining a sheet member at an inside corner of the frame structure, comprising:

a first frame structure panel member oriented in a first direction;

a second frame structure panel member oriented in a second direction that is oblique to said first direction;

said first panel member and said second panel member being arranged to form said inside corner;

a gap disposed between a rear edge of said second panel member and a face of said first panel member, said gap having a nominal gap width;

one or more retaining members partially closing said gap to provide one or more corresponding areas of reduced gap width, each of said retaining members being formed on or attached to a surface of said first panel member or said second panel member that defines a first side or a second side of said gap without mechanically fastening said retaining members to both sides of said gap; and said nominal gap width being sized to receive one or more bead elements disposed on one side of said sheet member, and said reduced gap width being sized to trap said one or more bead elements within said gap;

whereby, said rigid frame structure is configured so that said sheet member is capable of covering said first panel member and said second panel member, and so that said one or more bead elements are trapped in said gap by said one or more retaining members in order to retain said sheet member to said inside corner;

said first panel member and said second panel member being respectively provided by first and second tread/riser units for a rigid stair or bench assembly that has a corner retaining configuration for retaining a sheet member at an inside corner of the stair or bench assembly, said first and second tread/riser units each comprising:

a tread oriented in a first direction;

a riser oriented in a second direction that is substantially perpendicular to said first direction;

a front edge of said tread meeting a top edge of said riser to define an outside corner;

said first tread/riser unit being rearwardly adjacent to said second tread/riser unit and said second tread/riser unit being forwardly adjacent to said first tread/riser unit;

said first panel member comprising said riser of said first tread/riser unit;

said second panel member comprising said tread of said second tread/riser unit;

a rear edge of said tread of said second tread/riser unit having a first downwardly depending mounting flange;

a front face of said riser of said first tread/riser unit having second downwardly depending mounting flange; and said first downwardly depending mounting flange on said second tread/riser unit being attached to said second downwardly depending mounting flange on said first tread/riser unit to form said inside corner, with said gap having said nominal gap width being being situated between said rear edge of said tread of said second tread/riser unit and said front face of said riser of said rearwardly adjacent first tread/riser unit.

15. The frame structure of claim 14, wherein said one or more retaining members are integrally formed as tabs on said rear edge of tread of said second tread/riser unit or on said front face of said riser of said first tread/riser unit.

16. The frame structure of claim 14, wherein said second downwardly depending mounting flange on said first tread/riser unit comprises a forwardly extending dimension to define said gap.

17. The frame structure of claim 16, wherein second downwardly depending mounting flange on said first tread/riser unit is removably attached to said first downwardly depending mounting flange on said second tread/riser unit.

18. The frame structure of claim 14, in combination with one or more other tread/riser units of like construction to form said stair or bench assembly as a stair or bench system for a vinyl swimming pool, and wherein said frame structure is adapted for use with said sheet member comprised as a water-retaining vinyl liner for said swimming pool.

* * * * *